US008033346B2

(12) United States Patent
Kessler

(10) Patent No.: US 8,033,346 B2
(45) Date of Patent: Oct. 11, 2011

(54) BUMPER CAR

(75) Inventor: James J. Kessler, Winter Garden, FL (US)

(73) Assignee: Cyber Sport Manufacturing LLC, Winter Garden, FL (US)

( * ) Notice: Subject to any disclaimer, the term of this patent is extended or adjusted under 35 U.S.C. 154(b) by 160 days.

(21) Appl. No.: 12/231,397

(22) Filed: Sep. 2, 2008

(65) Prior Publication Data

US 2010/0051357 A1 Mar. 4, 2010

(51) Int. Cl.
*B62D 11/04* (2006.01)

(52) U.S. Cl. ..... 180/6.5; 180/65.1; 180/65.51

(58) Field of Classification Search ..... 180/6.2, 180/6.48, 6.5, 65.1, 65.51
See application file for complete search history.

(56) References Cited

U.S. PATENT DOCUMENTS

| | | | | |
|---|---|---|---|---|
| 4,324,301 | A | 4/1982 | Eyerly | |
| 4,898,382 | A | 2/1990 | Lamanna | |
| 5,435,404 | A * | 7/1995 | Garin, III | 180/6.5 |
| 6,070,898 | A * | 6/2000 | Dickie et al. | 280/304.1 |
| 7,243,746 | B1 * | 7/2007 | Vasant | 180/6.5 |
| 2007/0209851 | A1 * | 9/2007 | Sweringen et al. | 180/65.5 |

* cited by examiner

*Primary Examiner* — J. Allen Shriver, II
*Assistant Examiner* — Bryan Evans
(74) *Attorney, Agent, or Firm* — Simpson & Simpson, PLLC

(57) ABSTRACT

A bumper car for driving on a floor of a game arena including a chassis, first and second casters mounted to the chassis, first and second drive wheels mounted to the chassis, wherein the first caster is spring-loaded and the second caster is fixed, and a footwell for receiving feet of a driver of the bumper car, wherein a first distance is defined between a bottom surface of the footwell and the floor, wherein a second distance is defined between a mounting plate of the first caster, and wherein the first distance is less than the second distance.

8 Claims, 6 Drawing Sheets

BUMPER CAR

FIELD OF THE INVENTION

The invention relates to vehicles for games involving bumper cars, specifically for an improved bumper car with a lower center of gravity and enhanced performance.

BACKGROUND OF THE INVENTION

FIG. 1 shows one example of a prior art bumper car. U.S. Pat. No. 4,324,301 (Eyerly) and U.S. Pat. No. 4,898,382 (Lamanna) teach two more examples of prior art bumper cars. In each of these prior art cars, the footwells, or surfaces on which a player's feet rest are above the mounting surface of the casters of the vehicle and also above the bumper of the vehicle. Specifically in FIG. 1, it can be seen that prior art bumper car 1 includes seat 2 mounted atop base 3, which includes surface 4 and driving means 6 to operate the car. Bumper 8 is secured about the base of the car, and is located below surface 4. The feet of the driver of the car rest on surface 4, which is quite clearly located above bumper 8 of the prior art bumper car. Shield 9 is included to protect the feet of the driver of the car.

It has been found that a new design is required to utilize bumper cars in uses beyond traditional carnival rides. Specifically, new games have been developed which involve teams of players, each riding a bumper car in a game arena. In one such game, one team attempts to score more points than the opposing team by utilizing hand-held scoops to pick up and throw a ball into a goal for the respective team, all while players are bumping each others' cars. The prior art bumper cars are arranged so that the surface on which a player's feet rest is above the bumper and the mounting surface for the casters of the bumper car. This promotes the use of smaller diameter casters, which results in noisier, less responsive vehicles which are not suited for such a game.

Players in prior art bumper cars are positioned too high with respect to the floor so that they can not easily scoop up balls which are on the floor. This is especially difficult if the ball is in front of the vehicle, as the player must lean forward over the front of the vehicle. In addition, the bumper car must be made larger to account for the higher center of gravity which makes the cars less maneuverable, which significantly slows down the pace of such a game.

Furthermore, prior art bumper cars and similar vehicles have casters and/or wheels at fixed heights because the cars are powered by current running through conductive strips of metal on the floor of the arena, and electrical contacts on the vehicles must always be in contact with the conductive floor in order to power the vehicle. For example, see the patents to Eyerly and Lamanna, cited above. This also results in the need for the floor to be perfectly flat, or else the electrical contacts on the car might stop touching the floor, causing the vehicle to lose power, become less responsive, or stop functioning altogether. Even if a bumper car were to use an onboard power supply, the use of casters at fixed heights would result in a very uncomfortable ride by a driver of the bumper car over uneven flooring.

BRIEF SUMMARY OF THE INVENTION

The present invention broadly comprises a vehicle for driving on a floor of a game arena including a chassis, first and second casters mounted to the chassis, first and second drive wheels mounted to the chassis, and wherein the first caster is spring-loaded. In another embodiment, the second caster is fixed. In another embodiment, the second caster is spring-loaded.

In one embodiment, the first caster is arranged at a front end of the vehicle, the second caster is located at a back end of the vehicle, and the first and second drive wheels are located at a middle portion of the vehicle between the first and the second casters at a right side and a left side of the vehicle, respectively. In another embodiment, a first distance is defined between the floor and a first mounting plate for mounting the first caster to the chassis, a second distance is defined between the floor and a second mounting plate for mounting the second caster to the chassis, wherein the second distance is less than the first distance. In yet another embodiment, the vehicle further comprises a footwell for receiving feet of a driver of the vehicle, wherein a first distance is defined between a bottom surface of the footwell and the floor, wherein a second distance is defined between a mounting plate of the first caster, and wherein the first distance is less than the second distance.

The present invention also broadly comprises a vehicle for driving on a floor of a game arena including first and second casters, first and second drive wheels, a footwell for receiving feet of a driver of the vehicle, wherein a first distance is defined between a bottom surface of the footwell and the floor, wherein a second distance is defined between a mounting surface the first caster, and wherein the first distance is less than the second distance. In a another embodiment the first distance is less than approximately two inches. In yet another embodiment, a third distance is defined between a center of the first caster and the floor, and the first distance is less than the third distance.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 2:
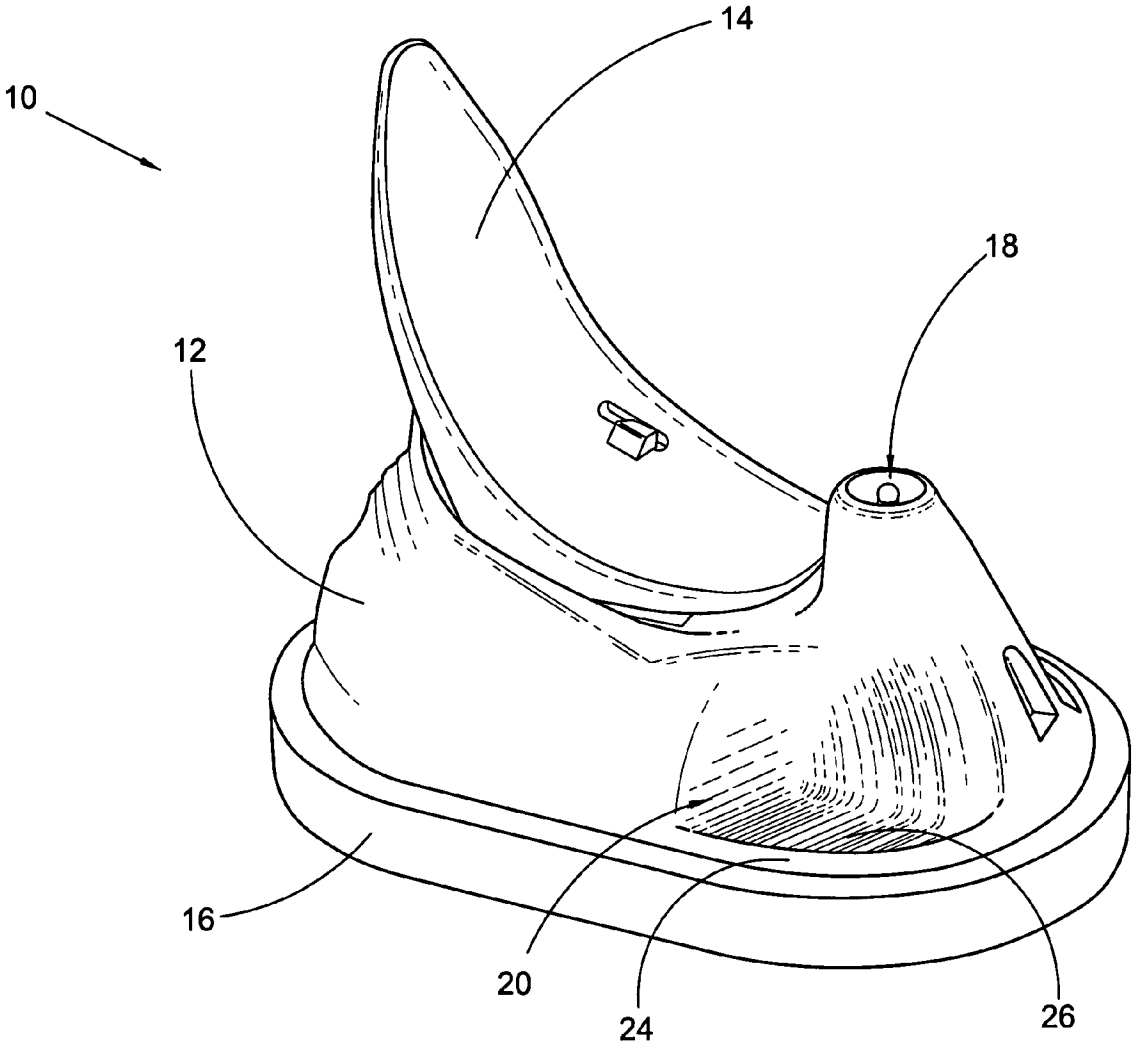
FIG. 2 is a perspective view of a bumper car according to the current invention.

Referring now to the drawings, FIG. 2 is a perspective view of bumper car 10. Bumper car 10 comprises body 12 which includes seat 14 mounted atop the body and bumper 16 peripherally arranged about the bottom of the body. Bumper car 10 also includes a steering means, specifically joy stick 18, enabling a driver to operate the bumper car. Footwell 20 can be seen as a recessed portion in body 12 that is partially hidden behind bumper 16. There are two footwells, generally arranged on the left and right sides of the car, with one footwell for each of the driver's feet. Footwell 20 includes bottom surface 26 on which the driver's feet rest.

Figure 3:
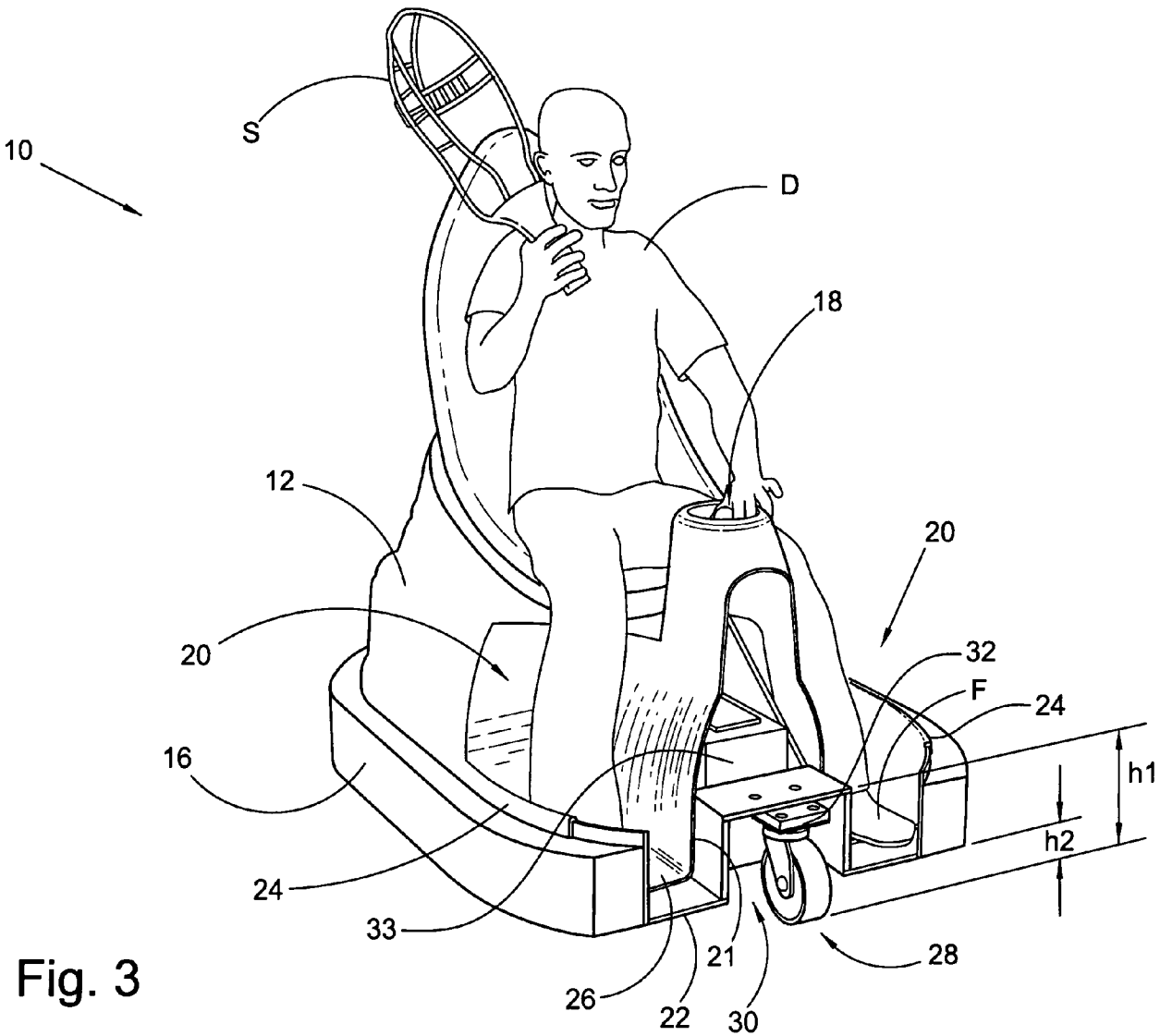
FIG. 3 is a perspective view of the bumper car shown in FIG. 2 having a front portion removed to show a front caster mounted in a recess of a chassis of the bumper car.

There is one footwell on either side of seat 14, so that when driver D is sitting in seat 14, feet F of the driver are resting in their respective footwells, as shown in FIG. 3. It should be clear that a front portion of bumper car 10 is removed in FIG. 3 to more clearly show the structure of car 10, namely, footwells 20 and front caster 28. Front caster 28 is located directly between the two footwells at the front of the bumper car mounted to chassis 22 in recess 30.

It can be seen in the shown preferred embodiment, that body 12 comprises essentially two different layers. The first layer is shell 21, is not used as a load bearing structure, but instead generally defines the shape of bumper car 10, protects the inner components and mechanisms, and provides aesthetics and color. In a preferred embodiment, shell 21 is a resilient, durable, and ductile material, such as any of several varieties of hard plastic. For convenience, a larger portion of the first layer is shown as removed in this Figure, so that the second layer can be seen protruding out from under the first, but it should be understood that this is for illustrative purposes only. The second layer generally comprises chassis 22, which is made from a rigid structural material such as steel, aluminum, or some other suitable metal. The chassis defines the frame of the car, and supports the seat, driving mechanisms, on board power supply, casters, and wheels. In a preferred embodiment, the total thickness of both layers equals about ¼-½ inch or so.

Front caster 28 can be seen located at the front of the bumper car mounted via mounting plate 30 to chassis 22. The front caster is mounted in recess 32, defined by chassis 22. It can be seen that recess 32 partially defines footwells 20 on either side of the recess. The footwells are also partially defined by outer walls 24, to which the bumper is affixed. Feet F of driver D rest on bottom surfaces 26 of the footwells. Advantageously a protective means, such as shield 9 in prior art car 1 is not needed, since feet F are located down in footwells 20 safely behind the bumper. Battery means 33 is an on-board rechargeable power supply to electrically power bumper car 10 located in the middle of the car under the seat.

Figure 1:
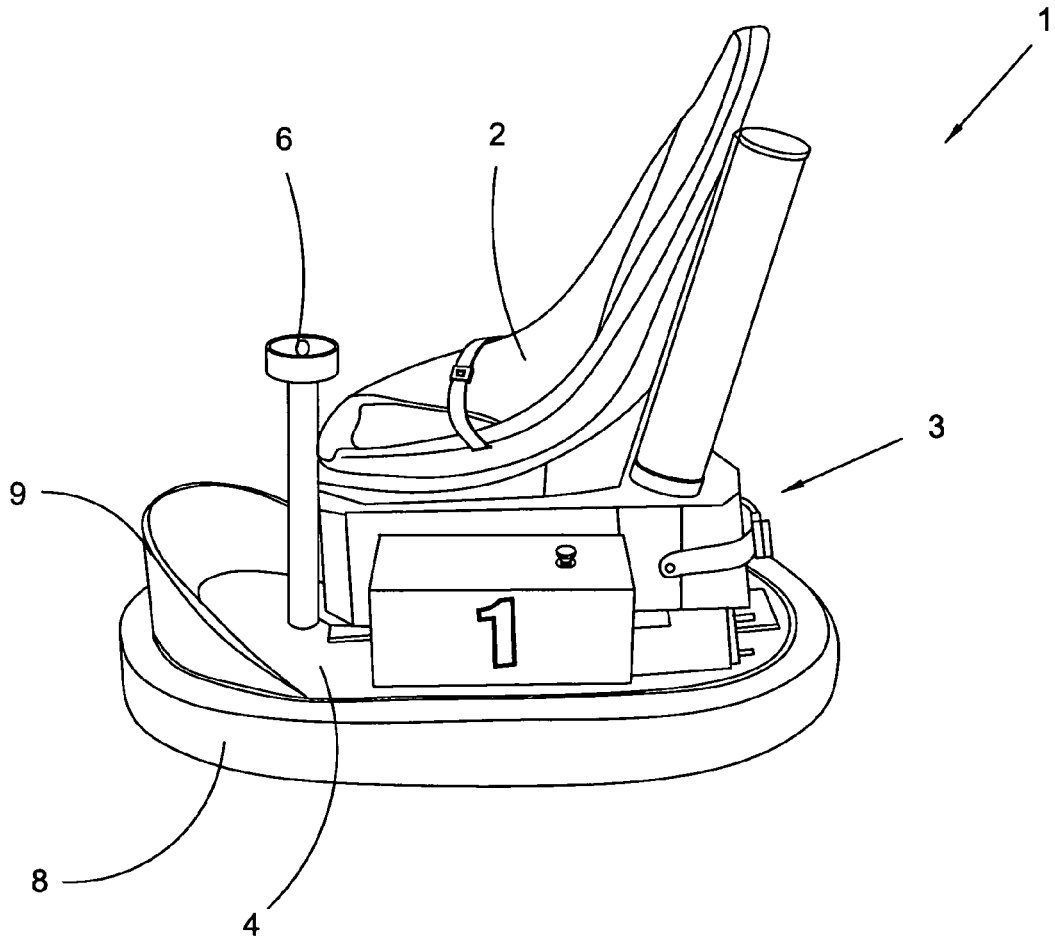
Prior Art Fig. 1
FIG. 1 is a perspective view of a prior art bumper car.

Without the recess, the driver's feet would have to rest on a platform elevated above the mounting plate, at height h1, where height h1 is measured between the floor and the portion of recess 30 to which the mounting plate is secured. Such a design is shown in FIG. 1 and the patents to Eyerly and Lamanna, discussed above. In the current invention, however, the driver's feet rest on surface 26 of the footwells at a height h2, where height h2 is measured between the floor and the bottom of the footwells. Therefore, the height of the vehicle can be reduced by an amount equal to the difference between heights h1 and h2, which results in increased stability and a smaller car size due to a lower center of gravity for both the driver and the bumper car, as seat 14 can be mounted to body 12 at a lower height.

Figure 4:
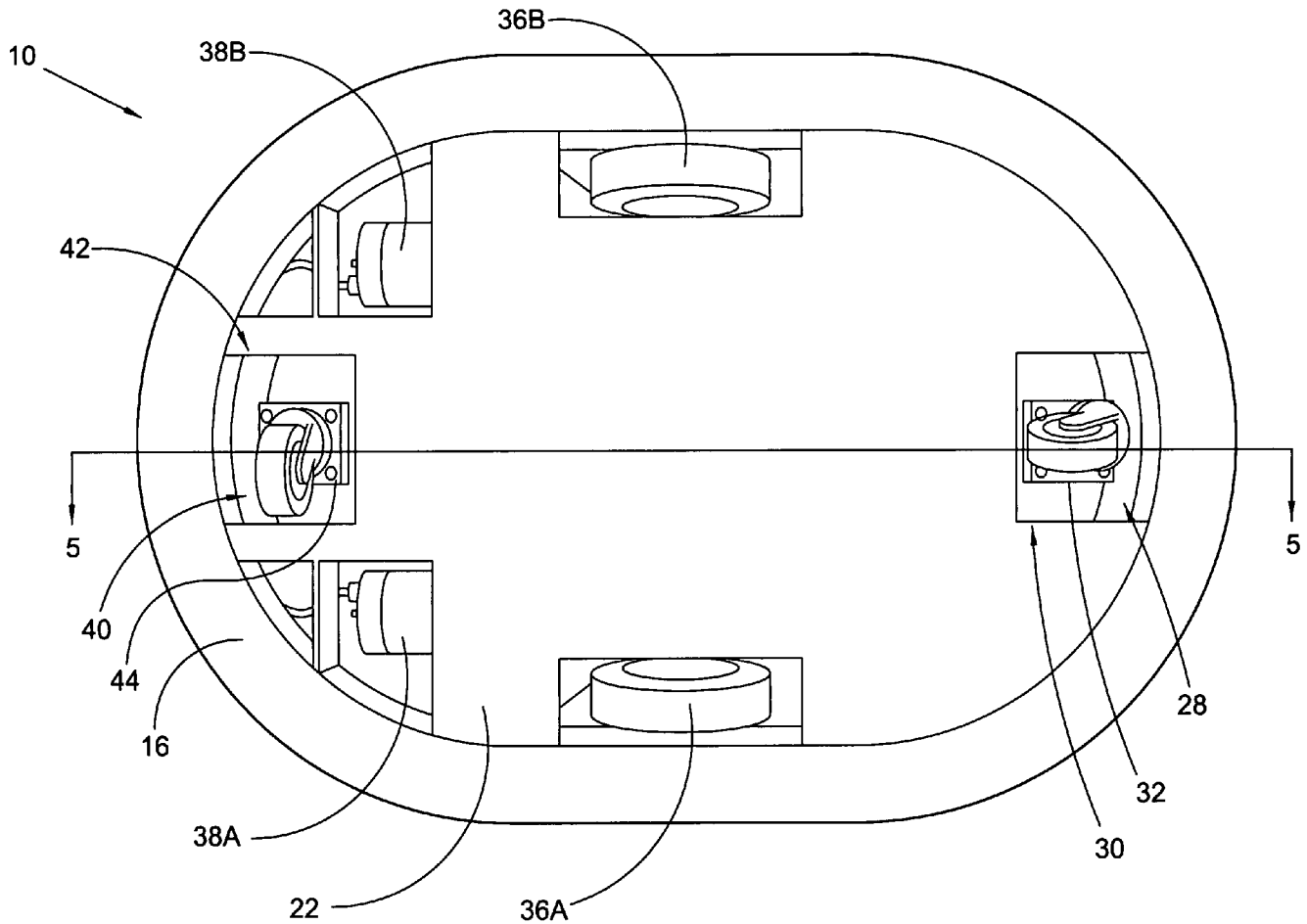
FIG. 4 is a bottom view of the bumper car shown in FIG. 2.

The bottom of car 10 is shown in FIG. 4. It can be seen that chassis 22 defines generally the entire bottom of bumper car 10. Drive wheels 36A and 36B are located in the middle of the car on the left and right sides of the car, respectively. The drive wheels are coupled to motors 38A and 38B, respectively, for driving the car. Joystick 18, or some other driving or steering means known in the art, communicates with the motors to control the output speed of the drive wheels for moving the car. Like front caster 28, rear caster 40 is mounted to chassis 22 in recess 42 via mounting plate 44.

Figure 5:
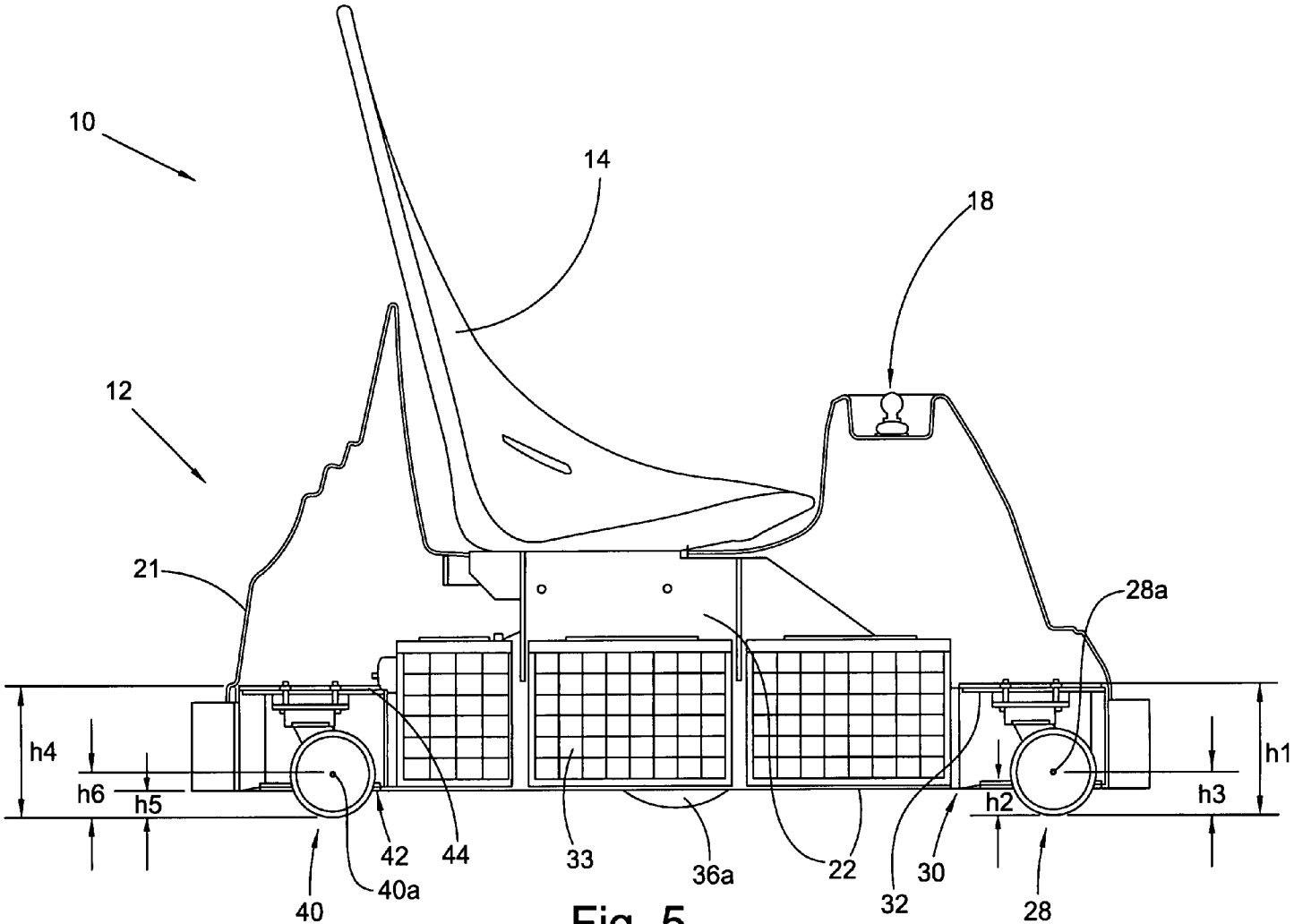
FIG. 5 is a cross-sectional side view of the bumper car shown in FIG. 2 having two fixed casters; and, FIG. 6 is a cross-sectional side view of the bumper car shown in FIG. 2 having a fixed rear caster and a spring-loaded front caster.

FIG. 5 shows a cross-sectional side view of bumper car 10. It can be seen that seat 14 is mounted on chassis 22 above onboard power supply 31. In the shown preferred embodiment, height h2 is also less than height h3, which is the distance measured between the floor and axis of rotation 28*a* of caster 28. Heights h4, h5, and h6 for rear caster 40 and recess 42 correspond to heights h1, h2, and h3 for the front caster. That is, height h4 is measured between mounting plate 44 and the floor, height h5 is measured between the chassis and the floor, and height h6 is measured between axis of rotation 40*a* and the floor. In a preferred embodiment, the radii of the casters, and therefore heights h3 and h6, are each approximately two inches, and height h2 is preferably one and a half inches. Reducing height h2 too much is not recommended because then the car may "bottom out" over uneven flooring, if too much material wears off of the casters over time, or if the chassis experiences some deflection or distortion, among other reasons. In FIG. 5 both the casters have a fixed height, and therefore heights h1, h2, and h3 respectively approximately equal heights h4, h5, and h6.

Figure 6:
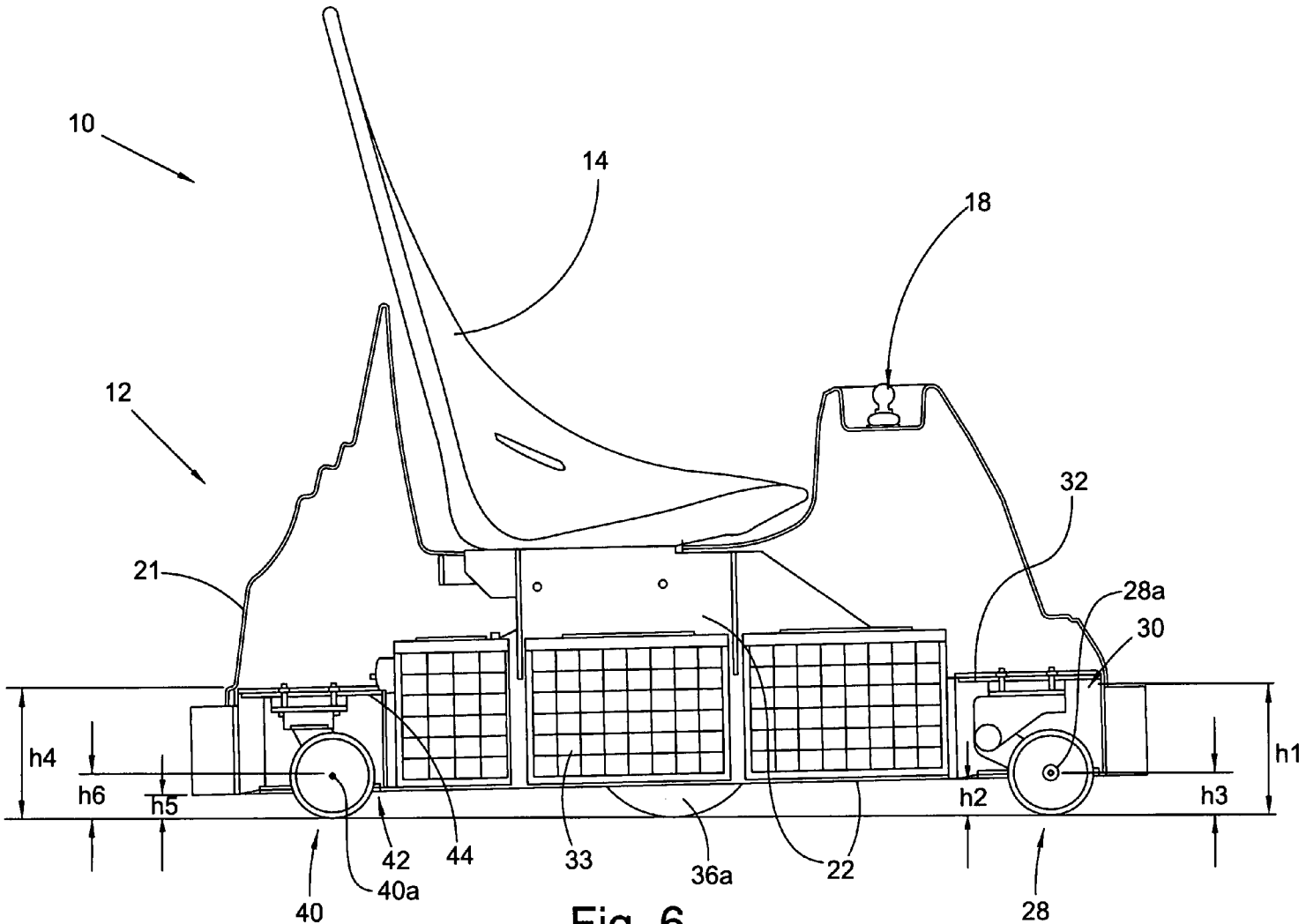

A cross-section similar to that in FIG. 5 is shown in FIG. 6. In this embodiment, caster 28 has been replaced by spring-loaded caster 46. The spring-loaded caster advantageously absorbs some of the forces that would otherwise be transferred into the chassis of the car. The front caster, as opposed to the back caster, has been replaced with a spring-loaded caster because while playing the game for which bumper car 10 is designed, the driver is constantly shifting his weight with respect to the front of the car, such as while leaning to side to side or forward in front of the car to retrieve a ball, or stretching upwards to block another player's shot or retrieve a pass from another player. The back caster could also be replaced with a spring-loaded caster, but it may not provide enough of a performance benefit to be cost effective.

In a preferred embodiment, heights h3 and h6 remain substantially equal, as the radii of the casters remains the same, but height h1 is now greater than height h4, and height h2 is now greater than height h5 in comparison to the car shown in FIG. 5. It is preferable to have height h1 noticeably greater than height h4 as shown, when no driver is seated in the car, as shown. Specifically, having height h1 greater than height h4 accounts for the compression of the springs in caster 46 when a driver is seated in the car. That is, the springs should have an appropriate spring-constant so that when a driver sits in the car, height h1 approximately equals height h4. The spring-loaded caster further increases the car's maneuverability and performance thus enabling a smoother ride for the driver. In addition, the spring-loaded caster increases the durability and lifespan of each bumper car 10 by absorbing the ever changing loads on the chassis. This is particularly important because the bumper car is experiencing not only changes due to the driver shifting his weight about the front of the car, but also because the car is constantly getting bumped by other bumper cars. Without the spring-loaded caster, some spots in the chassis may become weakened due to fatigue, and ultimately fail, which would require more frequent replacement of bumper cars in comparison to bumper cars which include the spring-loaded casters.

Furthermore, in prior art bumper cars, the height of the bumper is limited by the distance between the mounting plate and the floor. However, in the current invention the height of the bumper can be independently varied with respect to any other heights because of the presence of the footwells. Specifically, outer walls 24 of the footwells can be set to any desired height, and the bumper attaches directly to the outer walls. Therefore, if one wanted to create larger bumpers, they could just increase the height of outer walls 24 without changing the position of bottom surface 26 of the footwells.

It should be understood that although the current invention was designed to be used in game involving throwing balls via a scoop, such as scoop S shown in FIG. 3, through a goal while bumping other players also driving bumper cars, bumper car 10 could be used in a conventional bumper car ride found at an amusement park or carnival. Furthermore, the bumper car or advantages taught by the bumper car could be used in other unrelated vehicles which would benefit in a lower center of gravity, smaller size, or more maneuverability.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What we claim is:

1. A bumper car for driving on a floor of a game arena comprising:

a chassis;

exactly one first caster and a second caster, wherein said exactly one first caster is mounted to said chassis proximate to a front end of said bumper car and said second caster is mounted to said chassis proximate to a back end of said bumper car;

a pair of footwells formed about said first caster on left and right sides for receiving feet of a driver of said bumper car;

first and second drive wheels mounted to said chassis a steering device for operating said bumper car; and, a bumper peripherally surrounding said chassis, wherein said bumper is affixed to a pair of outer walls, wherein each outer wall extends up from bottoms of said footwells for partially defining said footwells, wherein said footwells are oppositely disposed on opposite lateral sides of said first caster and said steering device, wherein each footwell is operatively arranged to receive a foot of said driver for positioning said steering device and said first caster between legs of said driver.

2. The bumper car recited in claim 1 wherein said second caster is fixed.

3. The bumper car recited in claim 1 wherein said second caster is spring-loaded.

4. The bumper car recited in claim 1 wherein said first and second drive wheels are located at a middle portion of said bumper car between said first and said second casters, and at a right side and a left side of said bumper car, respectively.

5. The bumper car recited in claim 4 wherein a first distance is defined between said floor and a first mounting plate for mounting said first caster to said chassis, a second distance is defined between said floor and a second mounting plate for mounting said second caster to said chassis, wherein said second distance is less than said first distance.

6. The bumper car recited in claim 1 further comprising a footwell for receiving feet of a driver of said bumper car, wherein a first distance is defined between a bottom surface of said footwell and said floor, wherein a second distance is defined between a mounting plate of said first caster and said floor, and wherein said first distance is less than said second distance.

7. A bumper car for driving on a floor to enable a driver to play a recreational ball tossing game with handheld scoops, said bumper car comprising:

a chassis;

a bumper substantially completely surrounding said chassis peripherally and extending outward from said bumper car for cushioning collisions by or with said bumper car;

exactly one first caster and exactly one second caster, wherein said exactly one first caster is mounted to said chassis proximate to a front end of said bumper car, wherein said first caster is spring-loaded, and wherein said exactly one second caster is mounted to said chassis proximate to a back end of said bumper car;

a seat for said driver of said bumper car;

a steering device for operating said bumper car;

a pair of footwells formed proximate said front end of said bumper car, wherein said footwells are oppositely disposed on opposite lateral sides of said first caster and said steering device, wherein each footwell is operatively arranged to receive a foot of said driver for positioning said steering device and said first caster between legs of said driver, wherein said bumper is affixed to a pair of outer walls, wherein each outer wall extends up from bottoms of said footwells for partially defining said footwells;

wherein a first distance is defined between a bottom of said footwells and said floor, a second distance is defined between a mounting surface for said first caster and said floor, and said first distance is less than said second distance.

8. The bumper car recited in claim 7, wherein a third distance is defined between an axis of rotation of said first caster and said floor, and wherein said first distance is less than said third distance.

* * * * *